US011384770B2

(12) United States Patent
Fukami et al.

(10) Patent No.: US 11,384,770 B2
(45) Date of Patent: Jul. 12, 2022

(54) VACUUM PUMP, AND CONTROL DEVICE OF VACUUM PUMP

(71) Applicant: Edwards Japan Limited, Yachiyo (JP)

(72) Inventors: Hideo Fukami, Yachiyo (JP); Yoshinobu Ohtachi, Yachiyo (JP); Yasushi Maejima, Yachiyo (JP); Tsutomu Takaada, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 79 days.

(21) Appl. No.: 17/044,155

(22) PCT Filed: Mar. 20, 2019

(86) PCT No.: PCT/JP2019/011929
§ 371 (c)(1),
(2) Date: Sep. 30, 2020

(87) PCT Pub. No.: WO2019/202905
PCT Pub. Date: Oct. 24, 2019

(65) Prior Publication Data

US 2021/0123449 A1 Apr. 29, 2021

(30) Foreign Application Priority Data

Apr. 20, 2018 (JP) ..... JP2018-081113

(51) Int. Cl.
*F04D 19/04* (2006.01)
*F04D 27/00* (2006.01)
(Continued)

(52) U.S. Cl.
CPC ..... *F04D 27/001* (2013.01); *F04D 19/04* (2013.01); *F04D 19/042* (2013.01);
(Continued)

(58) Field of Classification Search
CPC ..... F04D 19/04; F04D 19/042; F04D 19/048; F04D 25/06; F04D 27/001; F04D 27/004;
(Continued)

(56) References Cited

U.S. PATENT DOCUMENTS 6,050,782 A 4/2000 Lembke et al.
8,248,019 B2 8/2012 Toshiaki
(Continued)

FOREIGN PATENT DOCUMENTS

CN 107202016 A 9/2017
JP 3169892 B2 5/2001
(Continued)

OTHER PUBLICATIONS

Extended Search Report from counterpart European Application No. 19788949.6 dated Nov. 23, 2021, 10 pp.
(Continued)

*Primary Examiner* — Dominick L Plakkoottam
*Assistant Examiner* — Charles W Nichols
(74) *Attorney, Agent, or Firm* — Shumaker & Sieffert, P.A.

(57) ABSTRACT

The present disclosure can provide a vacuum pump capable of obtaining a rotation direction and correcting the rotation direction without adding a dedicated rotation direction sensor even in a state of low-speed rotation. The control device is capable of obtaining at least a first state in which a rotor shaft rotates at relatively high speed, and a second state in which the rotor shaft deviates within a gap between the rotor shaft and a protective bearing and rotates at relatively low speed while revolving, acquires output information of a radial displacement sensor, obtains a rotation direction of the rotor shaft in the second state on the basis of the output information, determines whether the rotation direction is normal or not, and when the rotation direction is not normal,
(Continued)

stops the rotation and increases rotation speed to achieve a normal rotation direction.

2 Claims, 12 Drawing Sheets

(51) Int. Cl.
*F04D 29/058* (2006.01)
*F04D 29/053* (2006.01)
*F04D 29/056* (2006.01)

(52) U.S. Cl.
CPC ..... *F04D 19/048* (2013.01); *F04D 27/004* (2013.01); *F04D 29/053* (2013.01); *F04D 29/056* (2013.01); *F04D 29/058* (2013.01)

(58) Field of Classification Search
CPC .. F04D 27/0292; F04D 29/053; F04D 29/056; F04D 29/058; F05D 2270/821; F05D 2210/12
See application file for complete search history.

(56) References Cited

U.S. PATENT DOCUMENTS

| | | | | |
|---|---|---|---|---|
| 10,634,147 | B2 | 4/2020 | Kozaki | |
| 2013/0342140 | A1* | 12/2013 | Weslati | G01D 5/145 318/400.04 |

FOREIGN PATENT DOCUMENTS

| | | | | |
|---|---|---|---|---|
| JP | 2009121351 | A | * | 6/2009 |
| JP | 2009121351 | A | | 6/2009 |
| JP | 2011231760 | A | | 11/2011 |
| JP | 2012193705 | A | | 10/2012 |
| JP | 5276586 | B2 | | 8/2013 |
| JP | 2013185578 | A | | 9/2013 |

OTHER PUBLICATIONS

International Search Report and Translation thereof, dated Jun. 25, 2019, received in counterpart International Application No. PCT/JP2019/011929, 3 pp.

* cited by examiner (ENERGIZATION PATTERN B)

(ENERGIZATION PATTERN A)

| | | POLARITY OF $\Phi_{u\text{-}v}$ | DIRECTION OF ACTION OF TORQUE |
|---|---|---|---|
| POSITION A | NORMAL ROTATION DIRECTION | NEGATIVE | NORMAL ROTATION DIRECTION |
| | REVERSE ROTATION DIRECTION | POSITIVE | REVERSE ROTATION DIRECTION |
| POSITION B | NORMAL ROTATION DIRECTION | NEGATIVE | REVERSE ROTATION DIRECTION |
| | REVERSE ROTATION DIRECTION | POSITIVE | NORMAL ROTATION DIRECTION |
| POSITION C | NORMAL ROTATION DIRECTION | POSITIVE | REVERSE ROTATION DIRECTION |
| | REVERSE ROTATION DIRECTION | NEGATIVE | NORMAL ROTATION DIRECTION |
| POSITION D | NORMAL ROTATION DIRECTION | POSITIVE | NORMAL ROTATION DIRECTION |
| | REVERSE ROTATION DIRECTION | NEGATIVE | REVERSE ROTATION DIRECTION |

FIG. 7A

| POLARITY OF $\Phi_{u\text{-}v}$ | ENERGIZATION PATTERN | DIRECTION OF ACTION OF TORQUE |
|---|---|---|
| POSITIVE | A | REVERSE ROTATION DIRECTION |
| | B | NORMAL ROTATION DIRECTION |
| NEGATIVE | A | NORMAL ROTATION DIRECTION |
| | B | REVERSE ROTATION DIRECTION |

FIG. 7B

VACUUM PUMP, AND CONTROL DEVICE OF VACUUM PUMP

This application is a U.S. national phase application under 37 U.S.C. § 371 of international application number PCT/JP2019/011929 filed on Mar. 20, 2019, which claims the benefit of priority to JP application number 2018-081113 filed Apr. 20, 2018. The entire contents of each of international application number PCT/JP2019/011929 and JP application number 2018-081113 are incorporated herein by reference.

TECHNICAL FIELD

The present disclosure relates to a vacuum pump such as a turbomolecular pump, and a control device of the vacuum pump.

BACKGROUND

Generally a turbomolecular pump has been known as a type of vacuum pump (e.g., Japanese Patent No. 3169892). In this turbomolecular pump, the rotor blades are rotated by energization of the motor in the pump main body, and the gas molecules of the gas sucked into the pump main body are ejected to exhaust the gas. As this type of turbomolecular pump, there exists a turbomolecular pump that uses a three-phase DC brushless motor as the motor (e.g., Japanese Patent No. 5276586).

SUMMARY

In such turbomolecular pump described above, for example, in a startup standby state described hereinafter, the rotor blades may rotate in the reverse direction due to a reverse flow of the gas from the outlet port. This reverse rotation could cause the gas to return from the outlet side toward the inlet side or cause the rotor blades to keep rotating in the wrong direction due to delay in detection of the reverse rotation, resulting in a malfunction of the pump. In general, since the turbomolecular pump is designed to rotate in a normal rotation direction, the reverse rotation can create an unexpected load on the rotor blades or a load on the motor, possibly causing a malfunction of the turbomolecular pump. For this reason, in a case where reverse rotation occurs, it is desirable to detect the reverse rotation quickly and switch to the normal rotation. Examples of a method of detecting the rotation direction include providing any dedicated sensor (a rotation direction sensor such as a rotary encoder) to directly detect the rotation direction.

In a brushless motor such as the one disclosed in Japanese Patent No. 5276586, as long as a sufficiently high rotation speed (e.g., approximately 500 rpm) is reached, the rotation direction can be detected by obtaining the rotation phase from the relationship between the induced voltages generated in the coils of the respective phases, without providing a dedicated rotation direction sensor. In other words, for example, one of the coils of three phases can be used as an in-motor sensor (pickup coil), and then the rotation phase can be detected by comparing a signal waveform from the in-motor sensor with a rotation pulse waveform (drive pulse waveform) to the motor.

However, use of a dedicated rotation direction sensor for detecting the rotation direction results in an increase in the parts costs. In addition, if the rotation speed is not equal to or greater than a certain level (e.g., at least 300 rpm or higher) when detecting the induced voltages, the induced voltages would be so low that the rotation phase cannot be detected.

An object of the present disclosure is to provide a vacuum pump capable of obtaining a rotation direction and correcting the rotation direction without adding a dedicated rotation direction sensor even in a state of low-speed rotation, and a control device of the vacuum pump.

In order to achieve the foregoing object, the present disclosure is a vacuum pump, comprising:

a rotor shaft;

a motor that rotates the rotor shaft;

a magnetic bearing that magnetically levitates the rotor shaft;

a protective bearing with a predetermined gap between the protective bearing and the rotor shaft;

a displacement sensor that detects a position of the rotor shaft; and control means capable of controlling the motor and the magnetic bearing, wherein the control means:

is capable of obtaining at least a first state in which the rotor shaft rotates at relatively high speed, and a second state in which the rotor shaft deviates within the gap between the rotor shaft and the protective bearing and rotates at relatively low speed while revolving;

acquires output information of the displacement sensor;

obtains a rotation direction of the rotor shaft in the second state on the basis of the output information;

determines whether the rotation direction is normal or not; and when the rotation direction is not normal, stops the rotation and increases rotation speed to achieve a normal rotation direction.

In order to achieve the foregoing object, the present disclosure in another aspect is a control device of a vacuum pump, the control device being connected to a vacuum pump main body, the vacuum pump main body including:

a rotor shaft;

a motor that rotates the rotor shaft;

a magnetic bearing that magnetically levitates the rotor shaft;

a protective bearing with a predetermined gap between the protective bearing and the rotor shaft; and a displacement sensor that detects a position of the rotor shaft, wherein the control device:

is capable of obtaining at least a first state in which the rotor shaft rotates at relatively high speed, and a second state in which the rotor shaft deviates within the gap between the rotor shaft and the protective bearing and rotates at relatively low speed while revolving;

acquires output information of the displacement sensor;

obtains a rotation direction of the rotor shaft in the second state on the basis of the output information;

determines whether the rotation direction is normal or not; and when the rotation direction is not normal, stops the rotation and increases rotation speed to achieve a normal rotation direction.

The present disclosure can provide a vacuum pump capable of obtaining a rotation direction and correcting the rotation direction without adding a dedicated rotation direction sensor even in a state of low-speed rotation, and a control device of the vacuum pump.

BRIEF DESCRIPTION OF THE DRAWINGS

FIG. 7A is an explanatory diagram showing a relationship between a rotation direction of the rotor and the polarity of the magnetic flux estimation signal φu−v.

FIG. 7B is an explanatory diagram showing a relationship between the polarity of the magnetic flux estimation signal φu−v and a direction of action of the torque.

DETAILED DESCRIPTION

Figure 1:
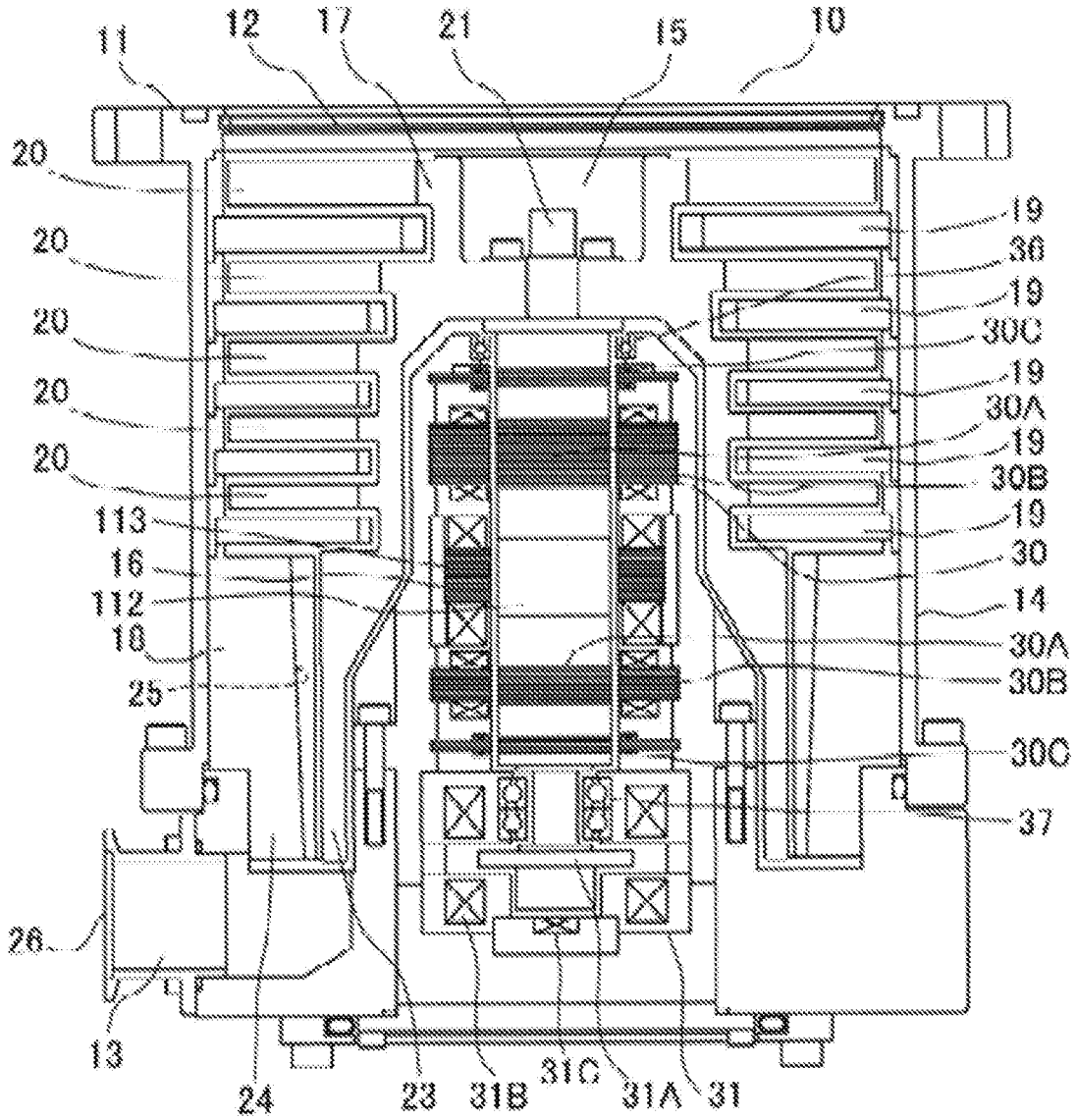
FIG. 1 is an explanatory diagram showing a cross section of a turbomolecular pump according to one aspect of the present disclosure and a schematic configuration of an inspection jig.

A vacuum pump according to one embodiment of the present disclosure is now described hereinafter with reference to the drawings. FIG. 1 schematically shows a vertical cross section of a turbomolecular pump 10 as the vacuum pump. The turbomolecular pump 10 is connected to a vacuum chamber (not shown) of a target device such as a semiconductor manufacturing device, an electron microscope, or a mass spectrometer.

The turbomolecular pump 10 integrally has a cylindrical pump main body 11 and a box-shaped electrical equipment case (not shown). The pump main body 11 has an inlet portion 12 on the upper side in the drawing which is connected to a side of the target device, and an outlet portion 13 on the lower side which is connected to an auxiliary pump or the like. The turbo molecular pump 10 can be used not only in a vertical posture in the vertical direction as shown in FIG. 1, but also in an inverted posture, a horizontal posture, and an inclined posture.

A power supply circuit portion for supplying electric power to the pump main body 11 and a control circuit portion for controlling the pump main body 11 are accommodated in the electrical equipment case (not shown), and the control of the pump main body 11 performed by these portions are described hereinafter.

The pump main body 11 has a substantially cylindrical main body casing 14. The inside of the main body casing 14 is provided with an outlet mechanism portion 15 and a rotary drive portion (referred to as "motor," hereinafter) 16. The outlet mechanism portion 15 is of a composite type composed of a turbomolecular pump mechanism portion 17 and a thread groove pump mechanism portion 18.

The turbomolecular pump mechanism portion 17 and the thread groove pump mechanism portion 18 are arranged in a continuous fashion in the axial direction of the pump main body 11; in FIG. 1, the turbomolecular pump mechanism portion 17 is disposed on the upper side in the diagram and the thread groove pump mechanism portion 18 is disposed on the lower side in the diagram. Basic structures of the turbomolecular pump mechanism portion 17 and the thread groove pump mechanism portion 18 are now schematically described hereinafter.

The turbomolecular pump mechanism portion 17 disposed on the upper side in FIG. 1 transfers gas using a large number of turbine blades, and includes stationary blades (referred to as "stator blades," hereinafter) 19 and a rotating blades (referred to as "rotor blades," hereinafter) 20 that each have a predetermined inclination or curved surface and are formed radially. In the turbomolecular pump mechanism portion 17, the stator blades 19 and the rotor blades 20 are arranged alternately in dozens of stages.

The stator blades 19 are provided integrally on the main body casing 14, and the rotor blades 20 are each sandwiched between upper and lower stator blades 19. The rotor blades 20 are integrated with a rotating shaft (referred to as "rotor shaft," hereinafter) 21 and rotates in the same direction as the rotor shaft 21 as the rotor shaft 21 rotates. In FIG. 1, the illustration of hatching showing the cross sections of components in the pump main body 11 are omitted in order to prevent the drawing from becoming complicated.

The rotor shaft 21 reaches from the turbomolecular pump mechanism portion 17 to the thread groove pump mechanism portion 18 on the lower side, and the motor 16 (to be described hereinafter) is disposed at an axially central portion. The thread groove pump mechanism portion 18 includes a rotor cylindrical portion 23 and a thread stator 24, wherein a thread groove portion 25, which is a predetermined gap, is formed between the rotor cylindrical portion 23 and the thread stator 24. The rotor cylindrical portion 23 is coupled to the rotor shaft 21 so as to be able to rotate integrally with the rotor shaft 21. An outlet port 26 to be connected to an outlet pipe is disposed below the thread groove pump mechanism portion 18, whereby the inside of the outlet port 26 and the thread groove portion 25 are spatially connected.

The motor 16 of the present embodiment is a three-phase brushless motor that can be driven at high frequencies. The drive motor 16 has a rotator (referred to as "rotor," hereinafter) 112 mounted on an outer periphery of the rotor shaft 21 and a stator (referred to as "stator," hereinafter) 113 disposed so as to surround the rotor. The electric power for activating the motor 16 is supplied by the power supply circuit portion or the control circuit portion accommodated in the electrical equipment case (not shown) described above. Drive control of the motor 16 having such a configuration is described hereinafter.

Magnetic bearings, which are non-contact type bearings by magnetic levitation, are used to support the rotor shaft 21. Two sets of radial magnetic bearings (radial direction magnetic bearings) 30 arranged above and below the motor 16 and one set of axial magnetic bearings (axial direction magnetic bearings) 31 arranged below the rotor shaft 21 are used as the magnetic bearings.

Of these magnetic bearings, each radial magnetic bearing 30 includes a radial electromagnet target 30A formed on the rotor shaft 21, a plurality of (two, for example) radial electromagnets 30B opposed to the radial electromagnet target, a radial displacement sensor 30C, and the like. The radial displacement sensor 30C detects a radial displacement of the rotor shaft 21. Then, based on the output of the radial displacement sensor 30C, excitation currents of the radial electromagnets 30B are controlled, and the rotor shaft 21 is supported in a levitating manner, so as to be able to rotate about a shaft center at a predetermined radial position.

The axial magnetic bearings 31 each include a disk-shaped armature disk 31A attached to a lower end portion of the rotor shaft 21, axial electromagnets 31B vertically opposed to each other with the armature disk 31A therebetween, an axial displacement sensor 31C installed slightly away from a lower end surface of the rotor shaft 21, and the like. The axial displacement sensor 31C detects an axial displacement of the rotor shaft 21. Then, based on the output of the axial displacement sensor 31C, excitation currents of the upper and lower axial electromagnets 31B are controlled, and the rotor shaft 21 is supported in a levitating manner, so as to be able to rotate about the shaft center at a predetermined axial position.

Use of these radial magnetic bearings 30 and axial magnetic bearings 31 can realize an environment where the rotor shaft 21 (and the rotor blades 20) is not worn out in spite of high speed rotation and therefore has a long life, eliminating the need of lubricating oil. Furthermore, in the present embodiment, by using the radial displacement sensor 30C and the axial displacement sensor 31C, the rotor shaft 21 rotates freely only in a rotational direction (θz) around the axial direction (Z direction), whereas positional control is performed on the rotor shaft 21 in the other five axial directions, i.e., X, Y, Z, θx, and θy directions.

Furthermore, radial protective bearings (also referred to as "protective bearings," "touch-down (T/D) bearings," "backup bearings," etc.) 36, 37 are arranged around upper and lower portions of the rotor shaft 21 at predetermined intervals. For example, even in case of trouble in an electrical system or if atmospheric entry or other trouble occurs, these protective bearings 36, 37 do not cause significant changes in the position and posture of the rotor shaft 21, preventing damage from occurring on the rotor blades 20 and surrounding portions thereof. Note, in the present embodiment, that the rotation direction of the rotor shaft 21 (and the rotor blades 20) can be detected using the protective bearings 36, 37, and specific details of detecting the rotation direction are described hereinafter.

When the motor 16 is driven under such a support structure of the rotor shaft 21 and thereby the rotor blades 20 rotate, gas is sucked from the inlet portion 12 shown on the upper side of FIG. 1, and the gas is transferred to the thread groove pump mechanism portion 18 side, while the gas molecules are caused to collide with the stator blades 19 and the rotor blades 20. In the thread groove pump mechanism portion 18, the gas transferred from the turbomolecular pump mechanism portion 17 is introduced to the gap between the rotor cylindrical portion 23 and the thread stator 24 and compressed in the thread groove portion 25. The gas inside the thread groove portion 25 enters the outlet port 26 from the outlet portion 13 and is then exhausted from the pump main body 11 via the outlet port 26. Here, the rotor shaft 21, the rotor blades 20 rotating integrally with the rotor shaft 21, the rotor cylindrical portion 23, the rotor 112 and the like can be collectively referred to as, for example, "rotor portion" or "rotating portion."

Figure 2:
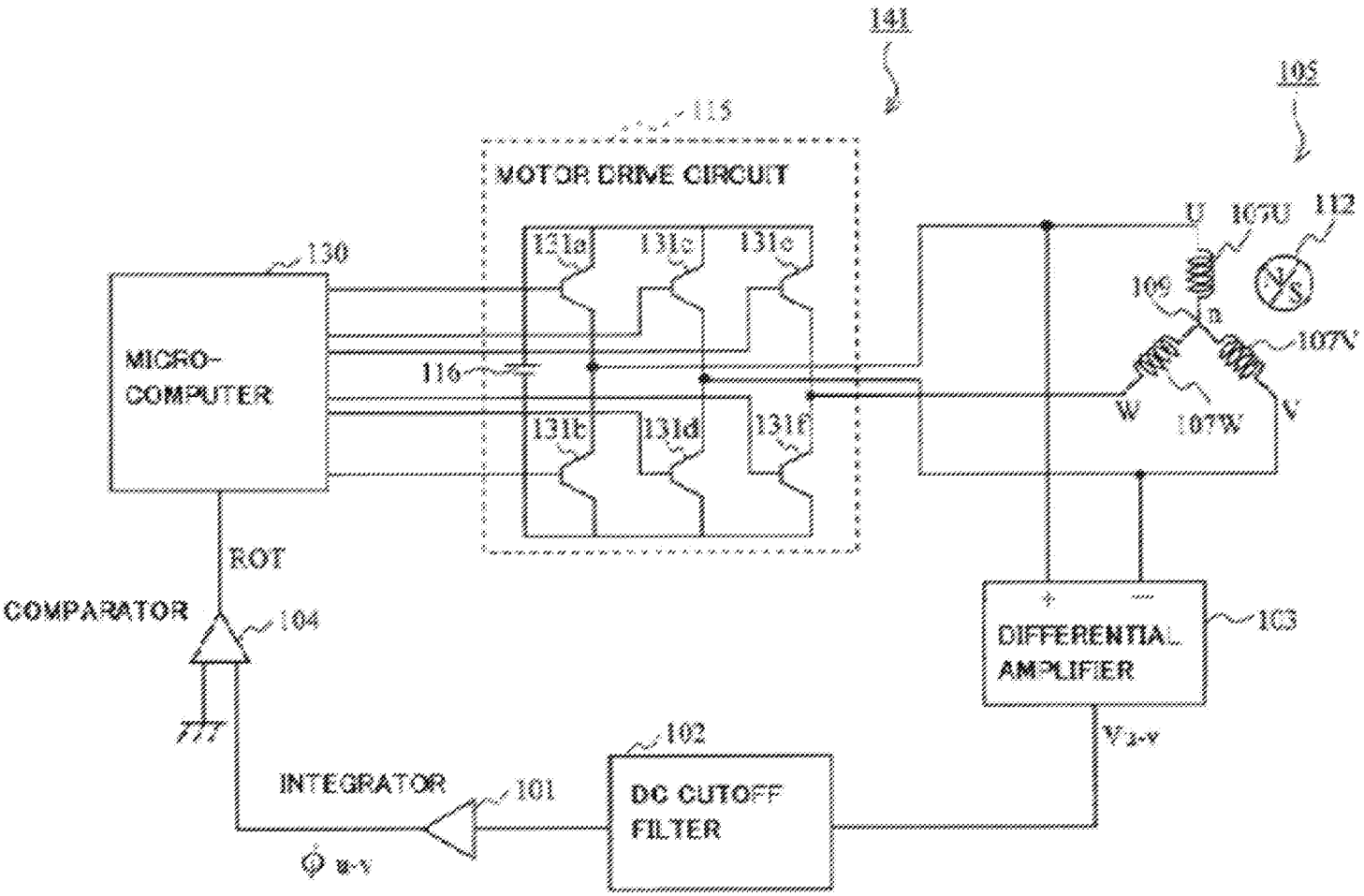
FIG. 2 is an explanatory diagram, schematically showing a configuration of a control circuit of a brushless motor.

The drive control of the motor 16 according to the present embodiment is described next with reference to FIGS. 2 to 7B. FIG. 2 schematically shows the main configuration of a control circuit 141 of the motor 16. Most of the control circuit 141 is included in the control circuit portion disposed inside the electrical equipment case (not shown). The control circuit 141 includes a motor wiring portion 105 provided in the motor 16, a motor drive circuit 115 for energizing the motor wiring portion 105, a microcomputer 130 as control means for controlling the motor drive circuit 115, and the like.

The motor wiring portion 105 has star-connected motor windings 107U, 107V, 107W and the like. The motor drive circuit 115 is also configured to supply currents to these motor windings 107U, 107V, 107W under the control of the microcomputer 130.

The motor 16 of the present embodiment does not have a magnetic pole sensor for detecting the positions of the magnetic poles of the rotor 112; the positions of the magnetic poles of the rotor 112 can be detected based on induced electromotive forces (induced powers) generated in the motor windings 107U, 107V, 107W. Although FIG. 2 shows the motor windings 107U, 107V, 107W and the rotor 112 arranged side by side in order to simplify the illustration, the motor windings 107U, 107V, 107W are arranged in an outer peripheral portion of the rotor 112.

The motor drive circuit 115 connected to the motor 16 includes a DC power supply 116 and six transistors 131*a* to 131*f* configuring a three-phase bridge. The base of each of the transistors 131*a* to 131*f* is connected to the microcomputer 130. Each of the transistors 131*a* to 131*f* is turned on/off by a base (gate) drive pulse from the microcomputer 130 and supplies a predetermined current to the motor windings 107U, 107V, 107W.

The control circuit 141 is further provided with a differential amplifier 103, a DC cutoff filter 102, an integrator 101, a comparator 104, and the like. The differential amplifier 103 is connected to the motor windings 107U, 107V of two phases out of the three phases. The differential amplifier 103 outputs a signal according to a potential difference Vu−v between a voltage Vu of the motor winding 107U and a voltage Vv of the motor winding 107V. Note that the subscripts u and v represent a U-phase terminal and a V-phase terminal, respectively. Hereinafter, the U-phase, V-phase, and W-phase potentials with respect to a midpoint 109 are referred to as Vu−n, Vv−n, and Vw−n, respectively. The subscript n represents the midpoint 109.

The DC cutoff filter 102 described above cuts off a DC component contained in an output signal of the differential amplifier 103. This is because, if the output of the differential amplifier 103 contains a DC component, the integrator 101 integrates the DC component, and therefore the DC cutoff filter 102 removes the DC component in advance. Note that a highpass filter can be used as the DC cut off filter 102.

The integrator 101 described above integrates the output of the differential amplifier 103 from which the DC component has been removed, and eliminates an electrical noise superimposed on the output of the differential amplifier 103. Normally, driving the motor 16 leads to generation of various electric noises. These noises are superimposed on signals obtained by the differential amplifier 103, and signals that are essentially necessary may be buried in the noises. Therefore, when the output signal of the differential amplifier 103 is integrated by the integrator 101, the noises are averaged and the signals buried in the noises (signals corresponding to the potential difference Vu−v) can be extracted.

These noises are random, and it can be considered that the noises are superimposed on both the positive and negative sides at substantially the same rate. In the integrated signal, noises are averaged and canceled. Integrating the potential difference Vu−v, that is, the potential difference between the motor winding 107U and the motor winding 107V, leads to generation of an interlinkage flux between the motor winding 107U and the motor winding 107V. Hereinafter, a signal that is output from the integrator 101 is represented as magnetic flux estimation signals (θu−v).

An input terminal of the comparator 104 described above is connected to the integrator 101 and the ground, and an output terminal of the same is connected to the microcomputer 130. The comparator 104 outputs a binary signal. This binary signal is a signal in which high and low voltages are associated with each other. Hereinafter, of these signals, the signal having a high voltage is referred to as Hi and the signal having a low voltage is referred to as Lo.

The comparator 104 compares the magnetic flux estimation signal with the ground level, and outputs Hi if the magnetic flux estimation signal is greater than the ground level, and outputs Lo if the magnetic flux estimation signal is smaller than the ground level. The comparator 104 generates a pulse signal synchronized with the rotor 112. Hereinafter, the output of the comparator 104 is referred to as a ROT signal (rotation pulse signal).

The microcomputer 130 receives the ROT signal from the comparator 104, switches the transistors 131*c*, 131*d*, 131*e*, 131*f* of the motor drive circuit 115 in synchronization with this ROT signal, and outputs a predetermined drive voltage vector to the motor windings 107V, 107W. Note that, in order to accelerate the control of the motor drive circuit 115, a DSP (Digital Signal Processor), for example, may be used in place of the microcomputer 130.

Next, the drive control in the two-phase mode according to the present embodiment, which is executed during a low-speed rotation period such as when the motor 16 is started or stopped, is described. The low-speed rotation period means a relatively low-speed period in which the rotation speed of the rotor 112 is less than a rotation speed at which a PLL circuit can be locked (such as a period in which the rotation speed is a degree of equal to or less than 500 rpm).

Figure 3B:
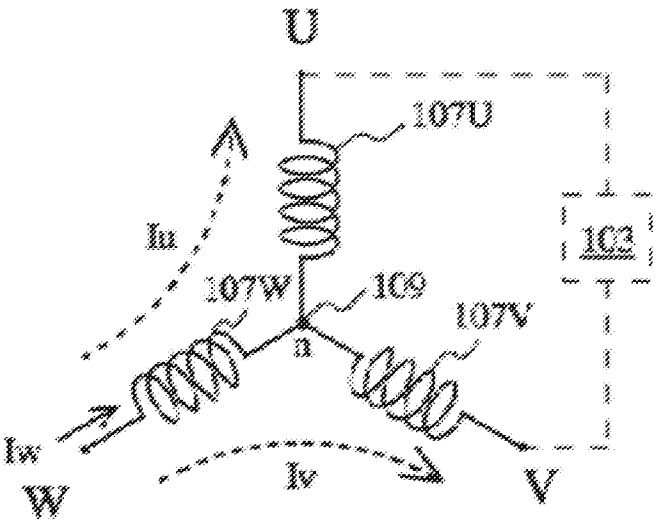
FIGS. 3A and 3B are explanatory diagrams showing energization patterns of starting currents in drive control in a two-phase mode.
Figure 3A:
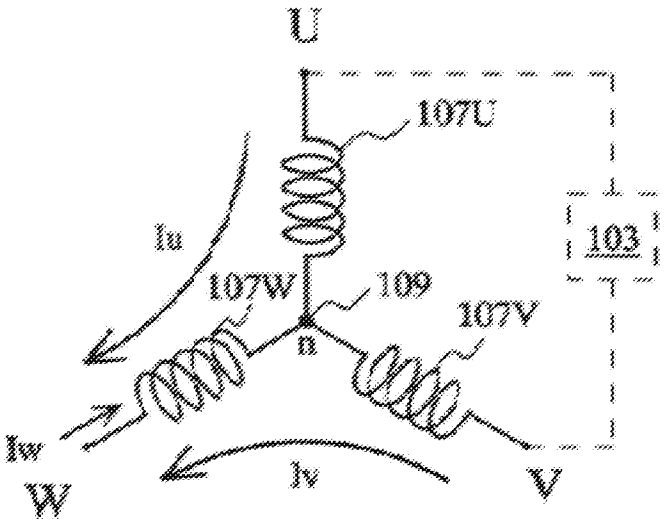

FIG. 3 is a diagram showing energization patterns of starting currents in the drive control in the two-phase mode. In the present embodiment, the control is performed during the low-speed rotation period using two energization patterns: an energization pattern A shown in FIG. 3A and an energization pattern B shown in FIG. 3B. In the energization pattern A shown in FIG. 3A, currents are applied simultaneously to the motor windings 107U, 107V, 107W in the U→W direction and the V→W direction. In the energization pattern B shown in FIG. 3B, currents are applied simultaneously to the motor windings 107U, 107V, 107W in the W→U direction and the W→V direction.

The current applied in the U→W direction is indicated as Iu, and the current applied in the V→W direction is indicated Iv. The current applied to the motor winding 107W is indicated as Iw. These Iu, Iv, Iw satisfy the following expression (1) in common with the energization patterns A and B, when the directions of the currents from U, V, and W of the respective motor windings to then of the midpoint 109 are positive.

$$Iu=Iv=-Iw/2 \quad (1)$$

In each energization pattern, a current equivalent to half the current flowing through the motor winding 107W flows through the motor windings 107U, 107V. A rectangular wave is used as the waveforms of the currents Iu, Iv, Iw. The W-phase motor winding 107W can be referred to as a first winding, and the U-phase and V-phase motor windings 107U and 107V can be referred to as a second winding.

Figure 4A:
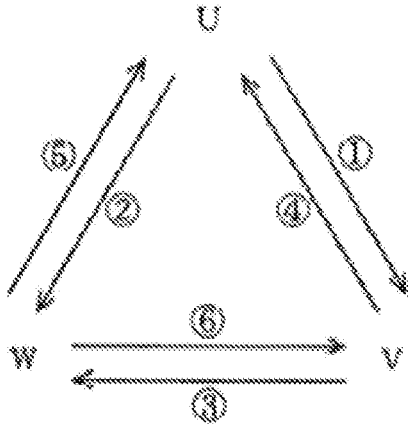
FIG. 4A is an explanatory diagram showing drive voltage vectors.

FIG. 4A is a diagram showing drive voltage vectors. As shown in FIG. 4A, there exist six types of drive voltage vectors that are output to the motor windings 107U, 107V, 107W of the three-phase full-wave type brushless motor. Hereinafter, the drive voltage vector for applying a current from the U-phase motor winding 107U to the V-phase motor winding 107V is referred to as a drive voltage vector 1, and the drive voltage vector for applying a current from the U-phase motor winding 107U to the W-phase motor winding 107W is referred to as a drive voltage vector 2.

Further, the drive voltage vector for applying a current from the V-phase motor winding 107V to the W-phase motor winding 107W is referred to as a drive voltage vector 3, and the drive voltage vector for applying a current from the V-phase motor winding 107V to the U-phase motor winding 107U is referred to as a drive voltage vector 4. In addition, the drive voltage vector for applying a current from the W-phase motor winding 107W to the U-phase motor winding 107U is referred to as a drive voltage vector 5, and the drive voltage vector for applying a current from the W-phase motor winding 107W to the V-phase motor winding 107V is referred to as a drive voltage vector 6. Also hereinafter, the respective drive voltage vectors are distinguished by these numbers "1" to "6." The numbers for these drive voltage vectors are circled (circled numbers) in FIG. 4A.

The energization pattern A is a state in which the drive voltage vector 2 and the drive voltage vector 3 are output simultaneously, and the energization pattern B is a state in which the drive voltage vector 5 and the drive voltage vector 6 are output simultaneously. In the energization pattern A, the transistors 131*a*, 131*c*, 131*f* are turned on to simultaneously output the drive voltage vectors 2 and 3, and in the energization pattern B, the transistors 131*b*, 131*d*, 131*e* are turned on to simultaneously output the drive voltage vectors 5 and 6. The adjustment of the currents flowing through the motor windings 107U, 107V, 107W in the energization patterns A, B is performed by causing the microcomputer 130 to execute PWM (pulse width modulation) control of base (gate) voltages of the transistors to be operated.

Figure 4B:
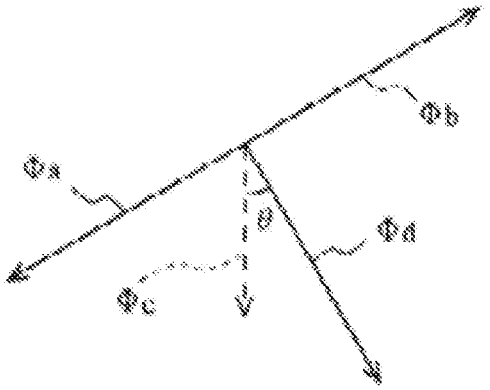
FIG. 4B is an explanatory diagram showing magnetic flux vectors generated during the drive control in the two-phase mode.

FIG. 4B is a diagram showing magnetic flux vectors generated during the drive control in the two-phase mode.

In the vector diagram shown in FIG. 4B, the magnetic flux vector generated during the energization pattern A is indicated by Φa, and the magnetic flux vector generated during the energization pattern B is indicated by Φb. The magnetic flux vector of a permanent magnet of the rotor 112 is indicated by Φc, and the rotation angle of the rotor 112 is indicated by θ. Note that θ is 0° for the magnetic flux vector Φd generated when the drive voltage vector 1 is output when a current is applied from the U-phase motor winding 107U to the V-phase motor winding 107V, and the clockwise direction in FIG. 4B is the positive (+) direction.

In the present embodiment, by alternating the energization by the energization patterns A and B, a magnetic field formed by the magnetic flux vectors Φa and Φb shown in FIG. 4B is generated in the motor windings 107U, 107V, 107W, and the rotor 112 is drawn to this magnetic field and rotated. The ROT signal is generated from the voltage difference between the U-phase terminal and the V-phase terminal, and with the ROT signal, the drive voltage vectors 2 and 3 in the energization pattern A and the drive voltage vectors 5 and 6 in the energization pattern B are subjected to feedback control.

Figure 4C:
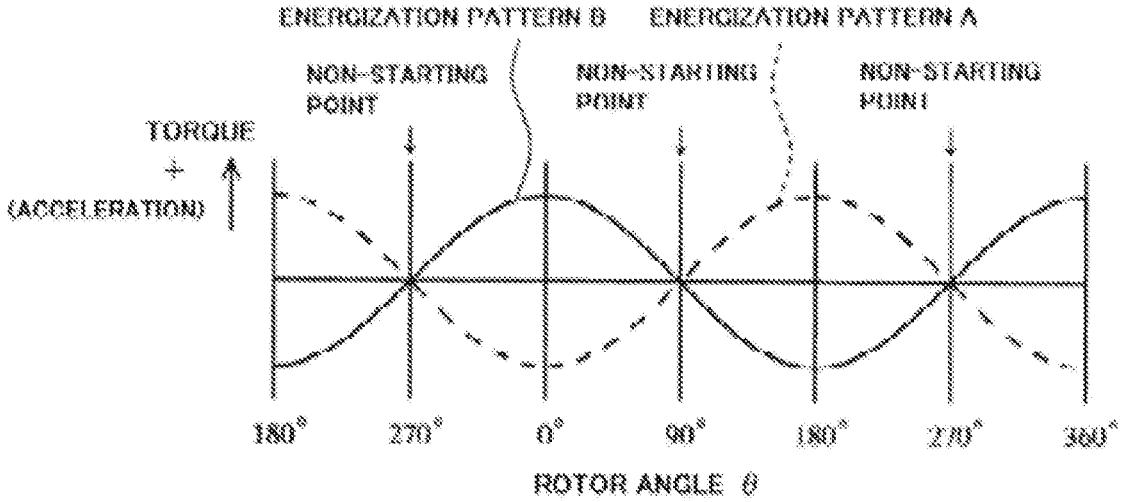
FIG. 4C is an explanatory diagram showing states of torques generated during the drive control in the two-phase mode.

FIG. 4C is a diagram showing states of torques generated during the drive control in the two-phase mode. As shown in FIG. 4C, the phase of the torque generated during energization pattern A and the phase of the torque generated during energization pattern B are 180° opposite to each other. During the drive control in the two-phase mode, torques of both positive (+) and negative (−) directions can be generated in the range excluding a non-starting point. The non-starting point indicates a state where neither positive nor negative torque cannot be generated when the rotor angle (rotation angle of the rotor shaft 21) θ is 90° and 270°.

Figure 5:
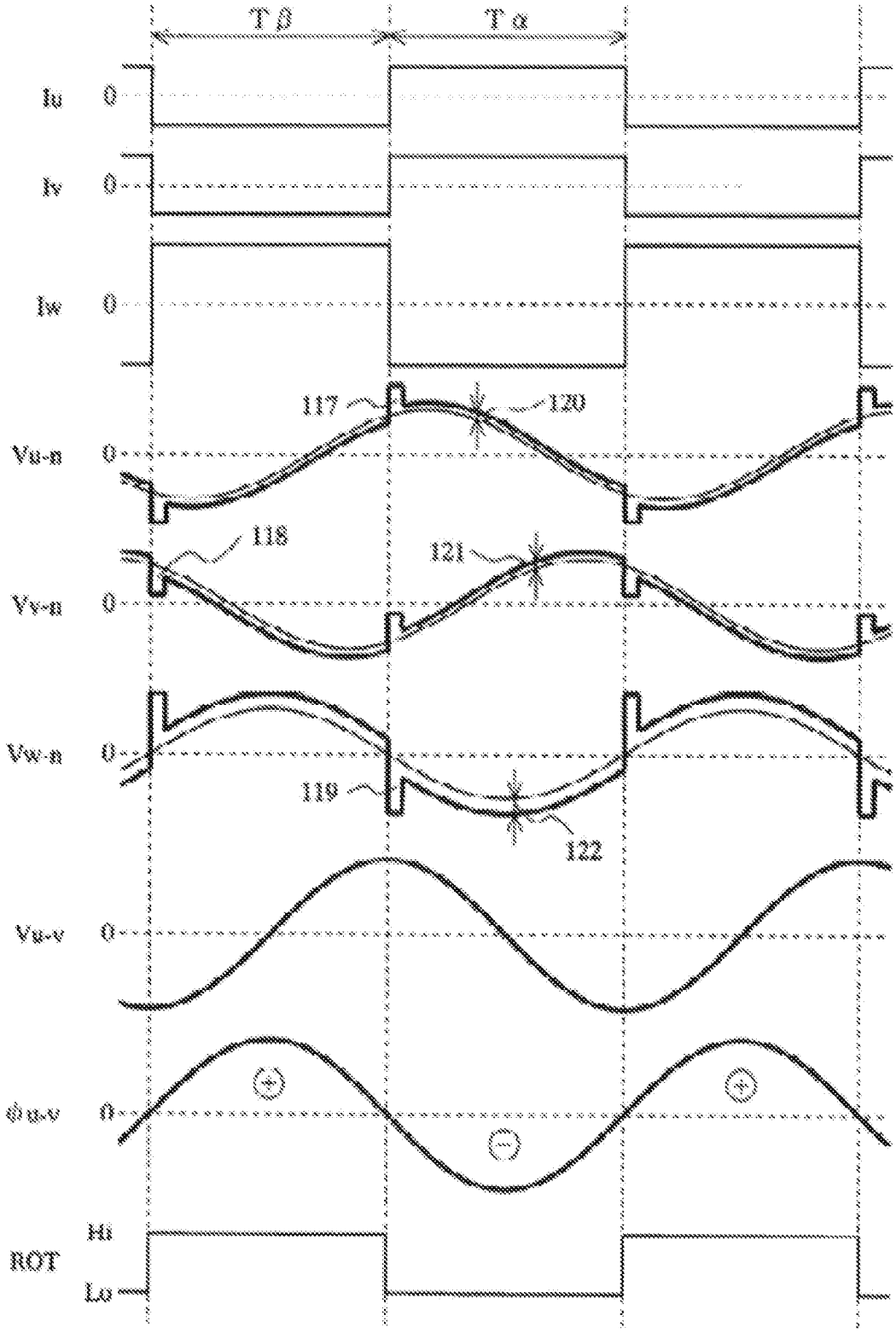
FIG. 5 is an explanatory diagram showing a relationship among currents Iu, Iv, Iw, voltages Vu−n, Vv−n, Vw−n, a potential difference Vu−v, a magnetic flux estimation signal φu−v output from an integrator, and a ROT signal output from a comparator, during acceleration of a rotor.

The drive control in the two-phase mode is described next by taking an operation during acceleration as an example. FIG. 5 shows a relationship among the currents Iu, Iv, Iw, the voltages Vu−n, Vv−n, Vw−n, the potential difference Vu−v, the magnetic flux estimation signal φu−v output from the integrator 101, and the ROT signal output from the comparator 104 during acceleration of the rotor 112; When the motor 16 is started, the energization patterns A and B are alternately repeated at a frequency close to DC, and the magnetic poles of the rotor 112 are attracted to and follow the magnetic field created by the motor windings 107U, 107V, 107W.

When the rotor 112 rotates approximately one revolution per second, the potential difference Vu−v between the motor winding 107U and the motor winding 107V can be detected as an interphase voltage. In the present embodiment, the potential difference Vu−v (interphase voltage) between the U-phase and the V-phase having the same phase and magnitude of the voltage drop due to inductances, as well as the same resistance component, is detected.

Currents flow in the U→W direction and the V→W direction while the drive voltage vectors 2 and 3 are output by the energization pattern A, currents flow in the W→U direction and the W→V direction while the drive voltage vectors 5 and 6 are output by the energization pattern B, and both currents flowing through the motor windings 107U and 107V flow through the motor winding 107W. Thus, the waveforms of the currents Iu, Iv, Iw are as shown in FIG. 5, respectively.

When the rotor 112 rotates by alternating the energization by the energization patterns A and B, the voltages Vu−n, Vv−n, Vw−n are generated as induced electromotive voltages in the motor windings 107U, 107V, 107W. A drive current flows through the motor windings 107U, 107V, 107W. Voltage spikes 117, 118, 119 and the like appear in the waveforms of the voltages Vu−n, Vv−n, Vw−n due to voltage drops and the like caused by the inductance of the motor windings 107U, 107V, 107W. The voltages Vu−n, Vv−n, Vw−n also contain DC components 120, 121, 122 resulting from the resistance components of the motor windings 107U, 107V, 107W.

In the present embodiment, the potential difference Vu−v between the voltages Vu−n and Vv−n is measured by the differential amplifier 103, and the positions of the magnetic poles of the rotor 112 are detected based on the potential difference Vu−v. Since the voltage spikes 117 and 118 of the same phase and the same size appear in the voltages Vv−n and Vu−n, these voltage spikes 117 and 118 can be eliminated (canceled) when the differential amplifier 103 obtains the difference between the voltages Vv−n and Vu−n. Also, since the DC components 120 and 121 of the same polarity and the same size are superimposed on the voltages Vv−n and Vu−n, these DC components 120 and 121 can be eliminated when the differential amplifier 103 obtains the difference between the voltages Vv−n and Vu−n.

The potential difference Vu−v is expressed by the following expression (2) using resistance components Ru, Rv, Rw of the motor windings 107U, 107V, 107W and inductances Lu, Lv, Lw of the respective phases.

$$Vu-v=Vu-n+Ru\times Iu+\omega\times Lu\times Iu-Vv-n-Rv\times Iv-\omega\times Lv\times Iv \quad (2)$$

where ω represents an angular velocity of the rotor 112.

In a case where the magnitudes of the resistance components Ru, Rv, Rw of the respective phases are the same and the magnitudes of the inductances Lu, Lv, Lw of the respective phases are the same, the potential difference Vu−v is expressed by the following expression (3) based on the expressions (1) and (2) above.

$$Vu-v=Vu-n-Vv-n \quad (3)$$

Specifically, the voltage drop caused by the resistance components Ru, Rv, Rw of the respective phases and the voltage drop caused by the inductances Lu, Lv, Lw cancel each other out and do not appear in the potential difference Vu−v. For this reason, the output of the differential amplifier 103, which is the potential difference Vu−v, is in synchronization with the rotation of the rotor 112 as shown in FIG. 5, and brings out a beautiful sine curve in which almost no noise appears. Note that, as described above, in a case where the resistance components Ru, Rv, Rw of the respective phases are the same, it is not always necessary to provide the DC cutoff filter 102 between the differential amplifier 103 and the integrator 101 since the DC components 120, 121 can be eliminated.

After the DC component of the potential difference Vu−v output from the differential amplifier 103 is cut off by the DC cutoff filter 102, the resultant potential difference Vu−v is input to the integrator 101. The integrator 101 integrates the potential difference Vu−v and outputs the magnetic flux estimation signal φu−v. The magnetic flux estimation signal φu−v is delayed by 90° from the potential difference Vu−v due to integration. Furthermore, the noises superimposed on the potential difference Vu−v are erased by being integrated. Note that the magnetic flux estimation signal φu−v and the potential difference Vu−v that are output from the integrator 101 have a relationship satisfying the following expression (4).

$$\varphi u-v=-\int Vu-vdt \quad (4)$$

In this manner, the magnetic flux estimation signal φu−v is obtained by integrating the potential difference Vu−v between the motor winding 107U and the motor winding 107V. Note that, as described above, since the potential difference Vu−v appears as a signal of a beautiful sine curve in which almost no noise appears, a beautiful magnetic flux estimation signal φu−v is obtained.

The comparator 104 compares the magnetic flux estimation signal φu−v with the ground level and outputs the ROT signal. The ROT signal output from the comparator 104 is Hi when the magnetic flux estimation signal φu−v is greater than the ground level, and the ROT signal is Lo when the magnetic flux estimation signal φu−v is smaller than the ground level.

Then, the microcomputer 130 receives the ROT signal from the comparator 104, energizes the starting current according to the energization pattern A when the ROT signal is Hi during acceleration, and energizes the starting current according to the energization pattern B when the ROT signal is Lo during acceleration. The control method employed at the time of acceleration has been described here, but the control method employed at the time of deceleration has an energization pattern opposite to that at the time of acceleration.

Next, feedback control executed during the drive control in the two-phase mode (low-speed rotation period) is described in detail. FIGS. 6A to 6D are each a diagram showing a positional relationship between the magnetic field created by the motor windings 107U, 107V, 107W during the drive control in the two-phase mode and the magnetic poles of the rotor 112. The positional relationships shown in FIGS. 6A to 6D are shown as positions A to D, respectively. As shown in FIGS. 6A to 6D, the positions A to D each have a different combination of the direction of the magnetic field created by the motor windings 107U, 107V, 107W and the directions of the magnetic poles of the rotor 112.

FIG. 7A is a diagram showing a relationship between the rotation direction of the rotor 112 and the polarity of the magnetic flux estimation signal φu−v, and FIG. 7B is a diagram showing a relationship between the polarity of the magnetic flux estimation signal φu−v and a direction of action of a torque. Note that the clockwise direction in FIGS. 6A to 6D is taken as the normal rotation direction, and the counterclockwise rotation is taken as the reverse rotation direction.

Figure 6A:
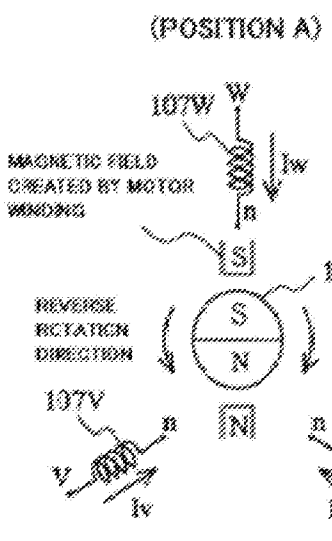
FIGS. 6A to 6D are each an explanatory diagram showing a positional relationship between a magnetic field created by a motor winding during the drive control in the two-phase mode and magnetic poles of the rotor.
Figure 6B:
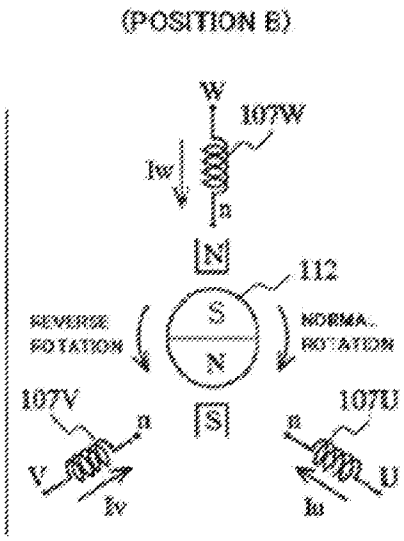
Figure 6C:
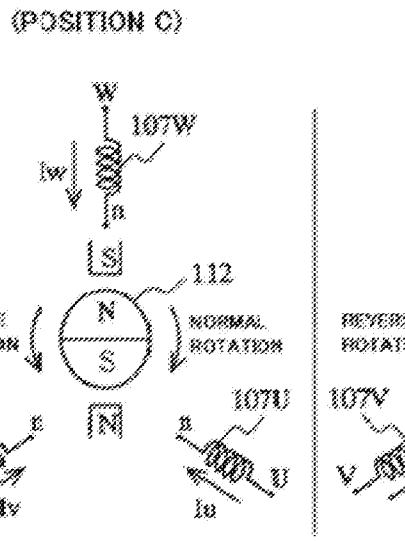
Figure 6D:
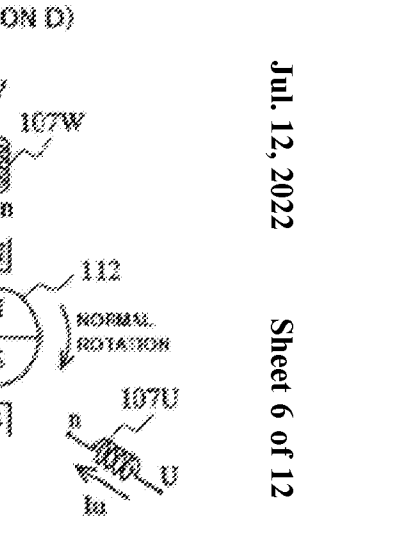

When the rotor 112 rotates in the normal rotation direction, the polarity of the magnetic flux estimation signal φu−v is negative (minus) while the magnetic field generated by the motor windings 107U, 107V, 107W and the positions of the magnetic poles of the rotor 112 are in the relationship shown in the position A of FIG. 6A. On the other hand, when the rotor 112 rotates in the reverse rotation direction, the polarity of the magnetic flux estimation signal φu−v is positive (plus) while the magnetic field generated by the motor windings 107U, 107V, 107W and the positions of the magnetic poles of the rotor 112 are in the relationship shown in the position A of FIG. 6A. Similarly, the relationship between the rotation direction of the rotor 112 and the polarity of the magnetic flux estimation signal φu−v is as shown in FIG. 7A.

As shown in FIG. 7B, during the drive control in the two-phase mode, the torque acts in the reverse rotation direction when the drive current of the energization pattern A is supplied during the period in which the polarity of the magnetic flux estimation signal φu−v is positive (plus). Conversely, the torque acts in the normal rotation direction when the drive current of the energization pattern B is supplied during the period in which the polarity of the magnetic flux estimation signal φu−v is positive (plus).

On the other hand, the torque acts in the normal rotation direction when the drive current of the energization pattern A is supplied during the period in which the magnetic flux estimation signal φu−v is negative (minus), and the torque acts in the reverse rotation direction when the drive current of the energization pattern B is supplied.

During the drive control in the two-phase mode described with reference to FIGS. 2 to 7B, the relationship shown in FIG. 7B is established among the polarity of the magnetic flux estimation signal φu−v, the energization patterns, and the direction of action of the torque. Specifically, by switching the output polarities of the U, V, and W phases according to the polarity of the magnetic flux estimation signal φu−v, the torque can be applied in a starting direction.

During the period in which the motor 16 is accelerated in the normal rotation direction, such as when the motor 16 is started, the energization patterns of the drive currents are controlled in such a manner that the torque acts in the normal rotation direction. On the other hand, during the period in which the motor 16 is accelerated in the reverse rotation direction (braking in the normal rotation direction), such as when the motor 16 is stopped, the energization patterns of the drive currents are controlled in such a manner that the torque acts in the reverse rotation direction.

For example, in a case where acceleration in the normal rotation direction is executed, as shown in FIG. 5, during a period Tβ in which the magnetic flux estimation signal φu−v is positive (the period in which the ROT signal is Hi), the drive current is supplied according to the energization pattern B to apply the torque in the normal rotation direction, and during a period Ta in which the magnetic flux estimation signal φu−v is negative (the period in which the ROT signal is Lo), the drive current is supplied according to the energization pattern A to apply the torque in the normal rotation direction.

In a case where acceleration in the reverse rotation direction is executed, during the period in which the magnetic flux estimation signal φu−v is positive, the drive current is supplied according to the energization pattern A to apply the torque in the reverse rotation direction, and during the period in which the magnetic flux estimation signal φu−v is negative, the drive current is supplied according to the energization pattern B to apply the torque in the reverse rotation direction.

According to the present embodiment, by switching between the energization patterns of the drive currents in the two-phase mode in accordance with the polarity of the magnetic flux estimation signal φu−v, the torque in a desired direction can be obtained appropriately, enabling smooth acceleration motion of the rotor 112 in the normal rotation direction or the reverse rotation direction. In other words, highly stable drive control can be ensured during the low-speed rotation period.

In addition, according to the present embodiment, since the impact of the voltage drops caused by the resistance components Ru, Rv, Rw of the motor windings 107U, 107V, 107W do not appear in the magnetic flux estimation signal φu−v, that is, the DC offset (superimposition) does not appear in the magnetic flux estimation signal φu−v, feedback control based on an appropriate signal can be performed, and more highly stable drive control can be ensured during the low-speed rotation period.

After the rotation speeds of the rotor shaft 21, the rotor blades 20 and the like in the rotor portion (referred to as "rotor shaft 21 and the like" hereinafter) increases up to the rotation speed at which the phase synchronization circuit (PLL circuit) can be locked, and thereby a rated rotation state is obtained, the microcomputer 130 switches the control method to a motor drive method of a three-phase mode in which the PLL circuit is used. In the present embodiment, the operating state and the control state obtained at the moment are referred to as a first state. Various typical methods can be adopted as the three-phase mode motor drive method; thus, detailed descriptions thereof are omitted.

Next, detection of the rotation direction of the rotor shaft 21 and the like and correction of the rotation direction based on the detection result are now described. The function of detecting the rotation direction and the function of correcting the rotation direction according to the present embodiment can be realized by the microcomputer 130 of the turbomolecular pump 10.

Figure 8:
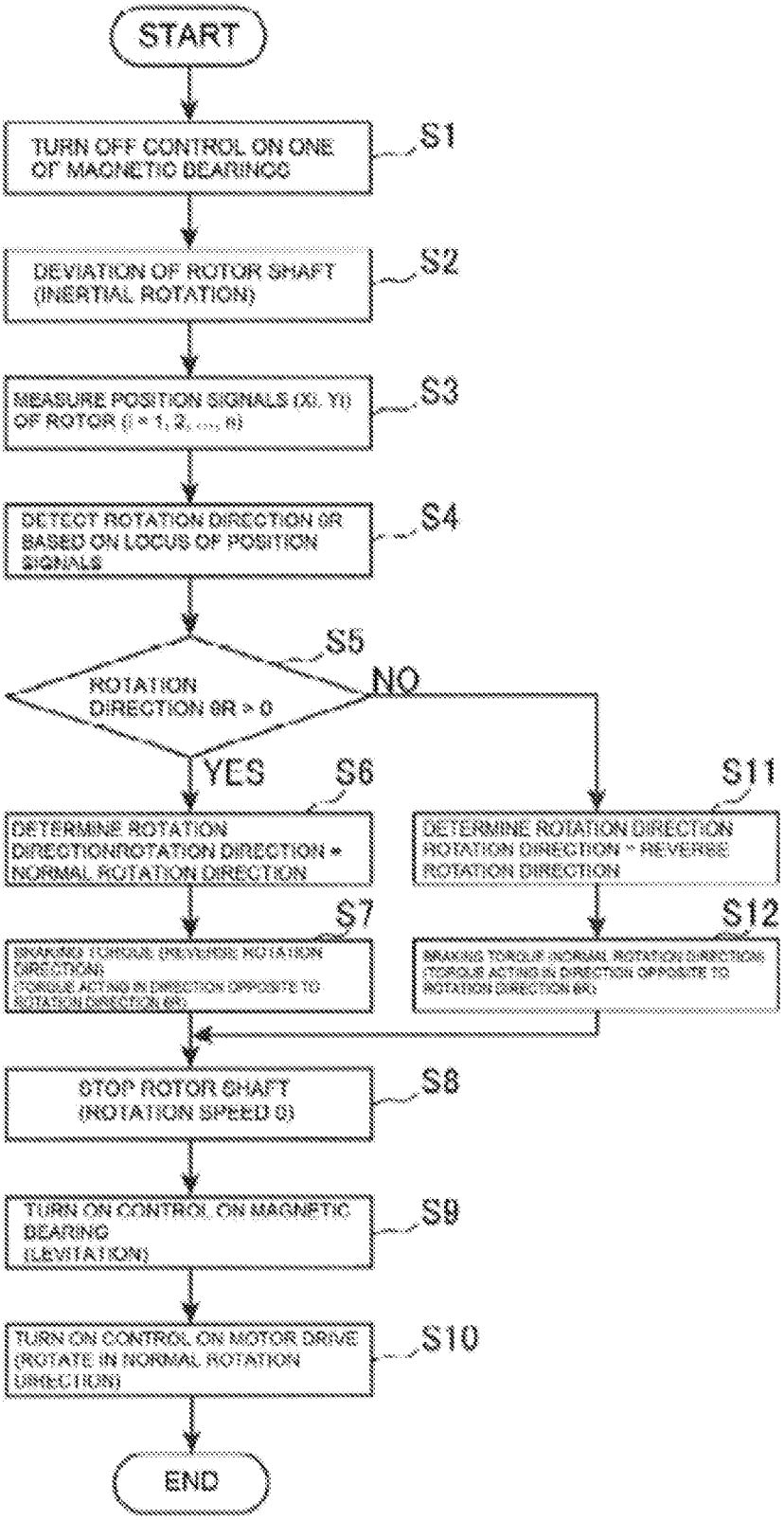
FIG. 8 is a flowchart, schematically showing a function of rotation direction detection performed by the inspection jig.

FIG. 8 functionally shows a process of detecting and correcting the rotation direction by means of the microcomputer 130. In detecting the rotation direction, first, control (biasing operation control) for causing the rotor shaft 21 to perform a biasing operation (i.e., shifted to one side) is performed. Examples of this control for the biasing operation include touchdown the rotor shaft 21 and biasing the rotor shaft 21 without causing it to touch down. The present embodiment adopts a control method for biasing the rotor shaft 21 without causing it to touch down.

In order to bias the rotor shaft 21 without causing it touch down, for example, a state can be obtained in which the levitation control on at least one of the upper and lower radial magnetic bearings 30 is made unbalanced. As described above, the radial magnetic bearings 30 include a plurality of (two, in this case) radial electromagnets 30B (FIG. 1). Thus, when energization of one of the radial electromagnets 30B is turned off, the levitation control becomes unbalanced. Then, the rotor shaft 21 is levitated under an asymmetric magnetic environment, and the rotor shaft 21 can be biased and revolved while maintaining the non-contact state between the rotor shaft 21 and the protective bearings 36, 37.

As shown in FIG. 8, first, the energization control (drive control) of the motor (reference numeral 16 in FIG. 1) in the low-speed rotation state is maintained, and the control on one of the magnetic bearings (one of reference numerals 30 and 31 in FIG. 1) is turned off (S1). Subsequently, the biasing operation of the rotor shaft 21, in which an appropriate momentum in the rotational direction remains, is performed (S2).

Due to the biased operation of the rotor shaft 21 described above, unlike the method of the present embodiment, when the rotor shaft 21 touches down to the protective bearings 36, 37, the rotor shaft 21 comes into contact with the protective bearings 36, 37. The rotation direction of the rotor shaft 21 may be reversed depending on the rotation speed of the rotor shaft 21 coming into contact with the protective bearings and the degree of friction therebetween. In order to prevent this reverse rotation of the rotor shaft 21 at the time of touchdown, the rotor shaft 21 is biased without causing it to touch down as in the present embodiment, and the center of the rotor shaft 21 is shifted even slightly from the shaft center thereof during steady rotation, and in this state the rotation direction may be detected based on position signals (Xi, Yi).

As a result of step S2, the rotor shaft 21 and the like are rotated at low speed while being tilted. In the present embodiment, the operating state or the control state at this time are referred to as a second state. The operating state or the control state between the first state (state of rated rotation) and this second state can be referred to as a third state or the like, to distinguish the third state from the first state and the second state.

Figure 9A:
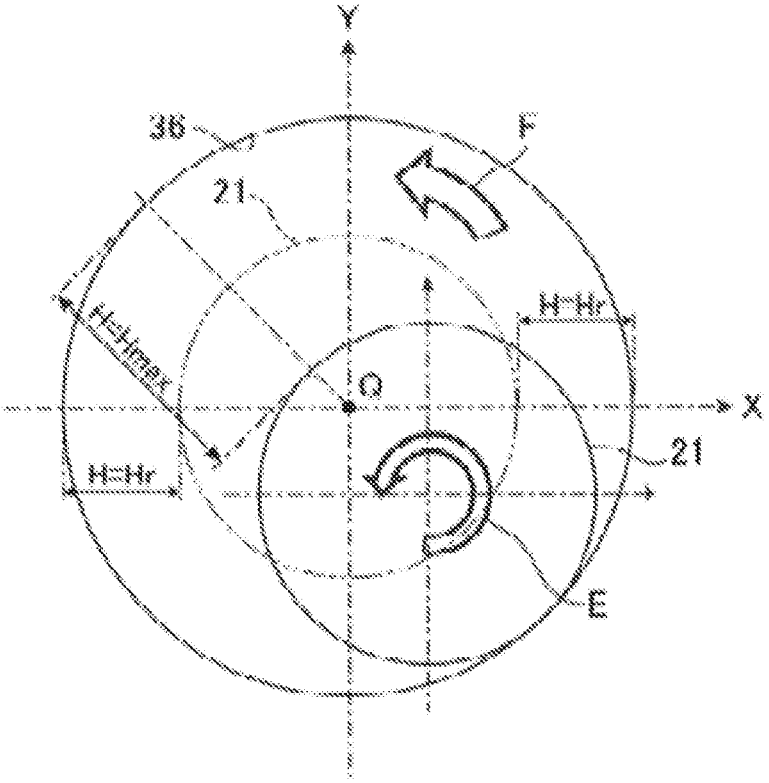
FIG. 9A is an explanatory diagram, schematically showing a relationship between a rotor shaft and a protective bearing.

FIG. 9A is a diagram of the rotor shaft viewed from below. The relationship between the rotor shaft 21 rotating at low speed while being tilted and the protective bearing (only the upper protective bearing 36 is shown here) is illustrated schematically. The rotor shaft 21 is located inside the protective bearing 36, and a gap H is present between an outer peripheral surface of the rotor shaft 21 and an inner peripheral surface of the protective bearing 36, as emphasized in the diagram.

When the rotor shaft 21 and (the inner peripheral surface of) the protective bearing 36 come into contact with each other, the gap H becomes 0 (zero) at the contacted part, and becomes the maximum value (Hmax) at the part where the phase is shifted by 180 degrees from the contacted part. When the rotor shaft 21 and the protective bearing 36 come into contact with each other, the gap (H=Hmax) at the part where the gap H is maximum is approximately 200 μm in the present embodiment. In the present embodiment, as described above, the low-speed rotation control of the rotor shaft 21 is performed in such a manner that this gap does not become 0 (so that the rotor shaft 21 and the protective bearing 36 do not come into contact with each other).

The rotor shaft 21 is biased within the range of the gap H between the rotor shaft 21 and the protective bearing 36 while rotating on its axis as indicated by the arrow E, and revolves around the axis as indicated by the arrow F. Although not shown, a similar gap H is formed not only at the upper protective bearing 36 but also at the lower protective bearing 37, Based from this fact, for example, as schematically shown in FIGS. 9A and 9B, the rotor shaft 21 rotates and revolves while being tilted with respect to the axial direction, within the range of the size of the gap H between the rotor shaft 21 and the upper and lower protective bearings 36, 37.

Figure 9B:
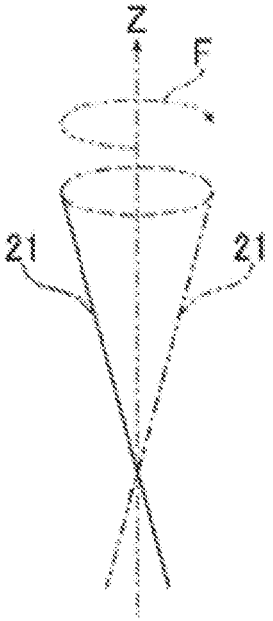
FIG. 9B is an explanatory diagram, schematically showing an inclination of the rotor shaft.

The directions of the arrows E and F and the directions of the X-axis and the Y-axis shown in FIGS. 9A and 9B are merely for explanation and simplification (omitting illustration). When monitoring the rotor shaft 21 from above and below in FIG. 1, for example, the rotor shaft 21 may appear differently depending on how to determine the coordinates in the horizontal plane and depending on the combinations thereof. The description is now made assuming that FIG. 9A shows a situation where the rotor shaft 21 is viewed from below.

Subsequently, as shown after S2 in FIG. 8, the position signals (Xi, Yi) as output information of the rotor shaft 21 are measured (S3). The position signal information is acquired at regular intervals, and the subscript i (=1, 2, 3, . . . ) indicates the difference in the timing of acquiring the position signals. By plotting the position information obtained from the position signals (X1, Y1), (X2, Y2), (X3, Y3), . . . in a chronological order, a diagram of a track 46 in the horizontal plane (in the XY plane) in association with the rotor shaft 21 is obtained, the diagram being illustrated in FIG. 10.

Figure 10:
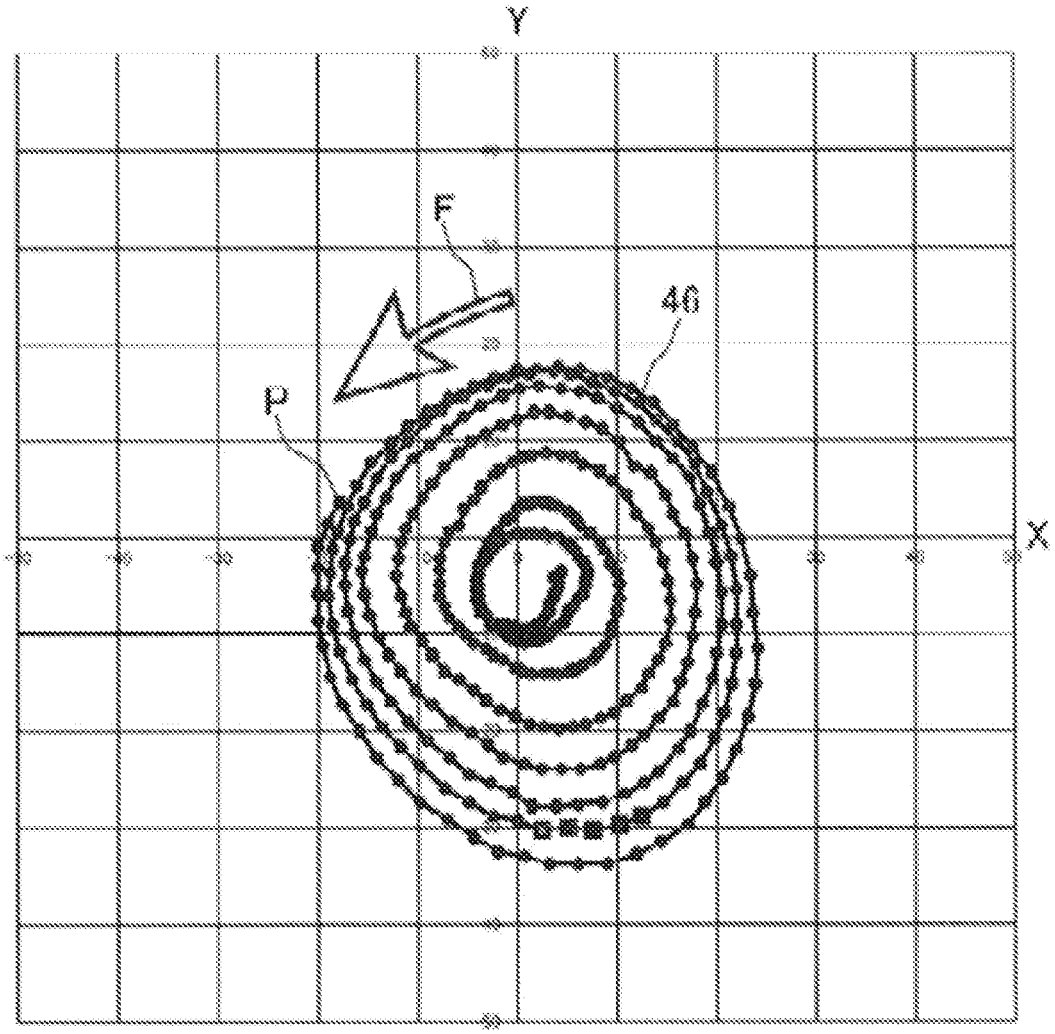
FIG. 10 is a graph showing an example of a track related to a detected displacement of the rotor shaft.

In FIG. 10, the positions where the position signals (Xi, Yi) are acquired are indicated by round dots, and continuous points are sequentially connected by a straight line. The arrow F in FIG. 10 indicates the revolution direction of the rotor shaft 21, and this revolution direction matches the arrow F shown in FIGS. 9A and 9B.

The point P shown in the upper left part of the diagram indicates the position of the position signals (Xi, Yi) acquired last (end point of the track 46). FIG. 10 illustrates the track 46 by the position signals (Xi, Yi) obtained from the radial displacement sensor 30C located at the upper part of the upper and lower radial displacement sensors 30C.

Subsequently, as shown after S3 in FIG. 8, a rotation direction θR is detected based on changes in the position signals (Xi, Yi) (S4). This rotation direction θR corresponds to the rotation direction of the rotor shaft 21 (for example, the direction indicated by arrow E in FIG. 9A), but in the present embodiment, the rotation direction θR is treated as the direction of revolution of the rotor shaft 21. The rotation direction θR of the rotor shaft 21 is determined based on the assumption that the rotor shaft 21 rotates in a direction that coincides with the revolution direction of the rotor shaft 21 determined based on the position signals (Xi, Yi).

Whether the rotation direction θR detected as described above is a normal direction or not is determined (S5). In the determination of S5, calculation is performed using the detected θR, and when θR is a positive value (S5: YES), it is determined that the rotation direction is the normal direction (S6). In the determination of S5, when θR is not a positive value (S5: NO), it is determined that the rotation direction is the reverse direction (S11).

When the rotation direction is the normal direction (S6), energization control in the reverse rotation direction is performed on the motor 16 so that braking torque is generated (S7). The braking torque in this case is a torque acting in the direction opposite to the detected normal rotation direction θR. Subsequently, the rotor shaft 21 and the like stop, and the rotation speed of the rotor shaft 21 and the like becomes 0 (S8). Thereafter, after the control of the magnetic bearings 30 and 31 is turned on to obtain a startup standby state (also referred to as a "levitation state" or "levitation mode") (S9), the drive control of the motor 16 is turned on and the motor is driven in the normal direction (S10).

When it is determined that the rotation direction is the reverse direction (as described for S11), energization control in the reverse rotation direction is performed on the motor 16 so that braking torque is generated (S12). The braking torque in this case is a torque acting in the direction opposite to the detected reverse rotation direction θR (normal direction).

Figure 11:
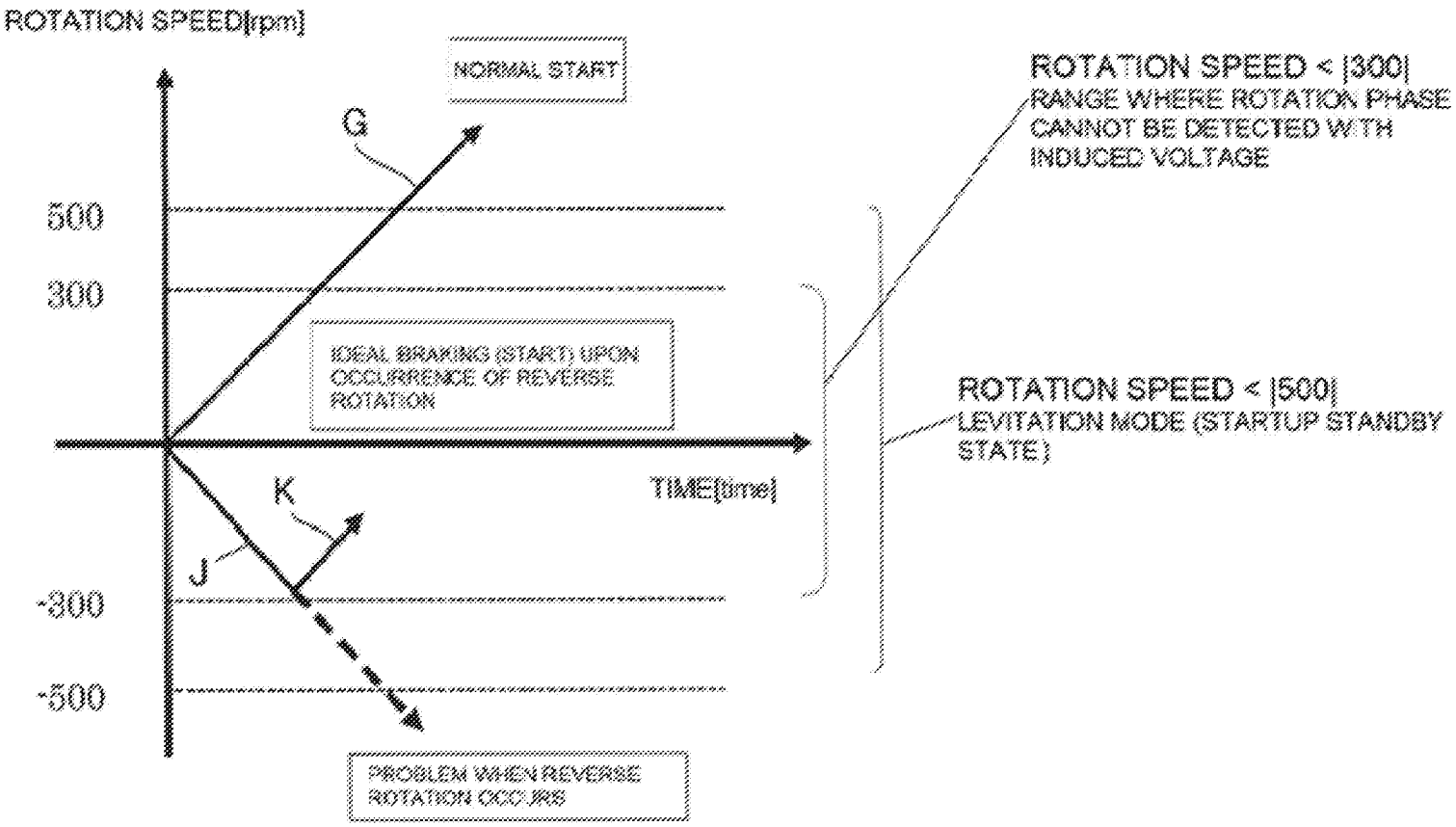
FIG. 11 is an explanatory diagram showing a relationship between rotation direction detection and braking during low-speed rotation.

FIG. 11 shows motor control performed in this case. In the diagram, the vertical axis represents the rotation speed (rotation speed), and the horizontal axis represents time. Regarding the rotation speed shown on the vertical axis, the rotation speed obtained when the rotation direction is normal is represented by a positive value such as "300" or "500," and the rotation speed obtained when the rotation direction is the reverse direction is represented by a negative value such as "−300" or "−500." As shown by the arrow G pointing to the upper right in the diagram, the rotation speed gradually increases when normal activation is performed in the normal direction.

In the region where the rotation speed is an absolute value of 500 rpm or less, the magnetic bearings 30 and 31 are turned on, but the motor is in a startup standby state (levitation mode) is obtained in which the motor drive control is not performed. However, the startup standby state described above also includes a state obtained immediately after the motor drive control is started. Especially a region where the rotation speed is an absolute value of less than 300 rpm is in a state in which the induced voltage of the motor 16 cannot be detected (state in which the rotation phase cannot be detected). Moreover, a region where the rotation speed is an absolute value greater than 300 rpm but less than 500 rpm is in the state in which the rotation phase cannot be detected or a state in which detection of the rotation phase is unstable.

On the other hand, in a case where reverse rotation occurs, the rotation speed of the reverse rotation gradually increases, as shown by the arrow J pointing to the lower right in the diagram. If no measures are taken, the rotation speed gradually rises in the opposite direction as shown by the extension of the broken line. However, as described above, when the reverse rotation is detected (S5 in FIG. 8: NO), the rotation speed decreases as shown by the arrow K pointing to the upper right, as a result of the generation of the braking torque in the normal direction (S12 in FIG. 8).

Then, the rotation speed of the motor 16 gradually approaches 0, and, although not shown in FIG. 11, the rotation direction of the motor 16 is reversed and corrected to the normal direction by the braking force. In this situation, the drive control of the motor 16 is turned on, and the motor is driven in the normal direction, gradually increasing the rotation speed of the motor 16.

The drive control of the motor 16 can be restarted after detecting that the rotation of the rotor shaft 21 and the like has been reversed to the normal direction. Also, without being limited thereto, the drive control of the motor 16 can be restarted when, for example, it is determined that a predetermined time has elapsed since the generation of the braking torque. Further, in the example shown in FIG. 11, the braking torque is generated in the situation where the rotation speed in the reverse direction is less than 300 rpm, but the braking torque may be generated after the rotation speed reaches, for example, 300 rpm.

As described above, the biasing operation of the rotor shaft 21 (S2) is performed for the following reasons. Namely, the rotation is stable during the rated rotation of the rotor shaft 21, and the rotor shaft 21 is positioned concentrically with the center of the radial magnetic bearing 30 and the protective bearing 36 (and 37) as shown by the two-dot chain line in FIG. 9A. Moreover, the gap (H=Hr) on each side between the outer peripheral surface of the rotor shaft 21 and the inner peripheral surface of the protective bearing 36 (and 37) is approximately 100 μm. The gap Hr in this rated state is substantially uniform throughout the entire circumference of the rotor shaft 21.

During the rated state as described above, the displacement (runout) of the rotor shaft 21 is relatively small, and the position signals (Xi, Yi) do not change much, making it difficult to detect the rotation direction. For this reason, in order to confirm the rotation direction in the present embodiment, the gap H is secured in the rotor shaft 21 so that the biasing operation of the rotor shaft 21 can be performed. Then, the amount of change in positional information is set to be large enough to easily recognize the positional difference, and then the rotation direction is detected based on the change in the position signals (Xi, Yi).

In addition, in the present embodiment, the rotation speed of the rotor shaft 21 is set at 0 once, as indicated by S8 in FIG. 8, for the following reasons. Specifically, in a case where the rotation speed is increased without stopping the rotor shaft 21 while the levitation control of the magnetic bearings is out of balance, even if the control is restored so that all the magnetic bearings are instantly turned on, it is also conceivable that the rotating components come into contact with the fixed components. Thus, in order to restore the levitation control from the unbalanced state thereof, it is desirable to either stop the rotor shaft 21 once and restore the control of all the magnetic bearings, to then raise the rotation speed, or to monitor the rotation speed of the rotor shaft 21 to prevent the rotation speed from drastically increasing to an excessively high rotation speed until the levitation control for the rotor shaft 21 becomes balanced. Of these methods, the present embodiment adopts the method of stopping the rotor shaft 21 once (setting the rotation speed at 0).

According to the turbomolecular pump 10 of the present embodiment described above, control is performed so that the rotor shaft 21 performs the biasing operation during the low-speed rotation. The radial displacement sensor 30C detects the rotation direction of the rotor shaft 21 and the like using the position signals (Xi, Yi). Therefore, the rotation direction can be detected by the existing detection device, without adding a dedicated device for detecting the rotation direction, such as a rotary encoder.

In a case where the detected rotation direction is not normal, the motor 16 is braked to reduce the rotation sped, as shown in FIGS. 8 and 11. Then, after the rotation of the motor 16 weakens and the rotation speed becomes 0, the rotation direction is reversed to the normal direction, and the rotation speed is increased in the normal rotation direction. This can enable smooth correction of the rotation direction. In addition, since the motor 16 is accelerated after the rotation speed is set at 0, outputting of an alarm due to re-acceleration of the motor during the reverse rotation by applying the braking torque can be prevented, enabling more appropriate correction of the rotation direction. According to the present embodiment, the rotation direction can be detected in the low-speed rotation state in which the induced voltage in the motor 16 is low. For these reasons, the reverse rotation can be detected easily and early, and consequently the rotation speed can be prevented from rising continuously during the reverse rotation.

Further, the function of biasing the rotor shaft 21 and the function of processing the output signal of the radial displacement sensor 30C are equipped in the microcomputer of the control circuit unit in a conventional turbomolecular pump, as well as the control program (software) used. Therefore, while utilizing many of the existing functions, the rotation direction can be detected simply by adding correcting the rotation direction as a minimum additional function.

Note that the present disclosure is not limited to the foregoing embodiment and therefore can be modified in various ways. For example, in the foregoing embodiment, the displacement of the rotor shaft 21 is detected by using the output signal (position signals) of the upper radial displacement sensor 30C of the upper and lower displacement censors. However, the present disclosure is not limited thereto; for example, an output signal (position signals) of the lower radial displacement sensor 30C may be used.

Also, in the process of S1 shown in FIG. 8, the rotor shaft 21 is biased without the low-speed rotation control of the motor 16 being turned off, but the process of detecting the rotation direction following S1 may be performed by turning off the low-speed rotation control and causing the rotor shaft 21 to touch down.

Figure 12:
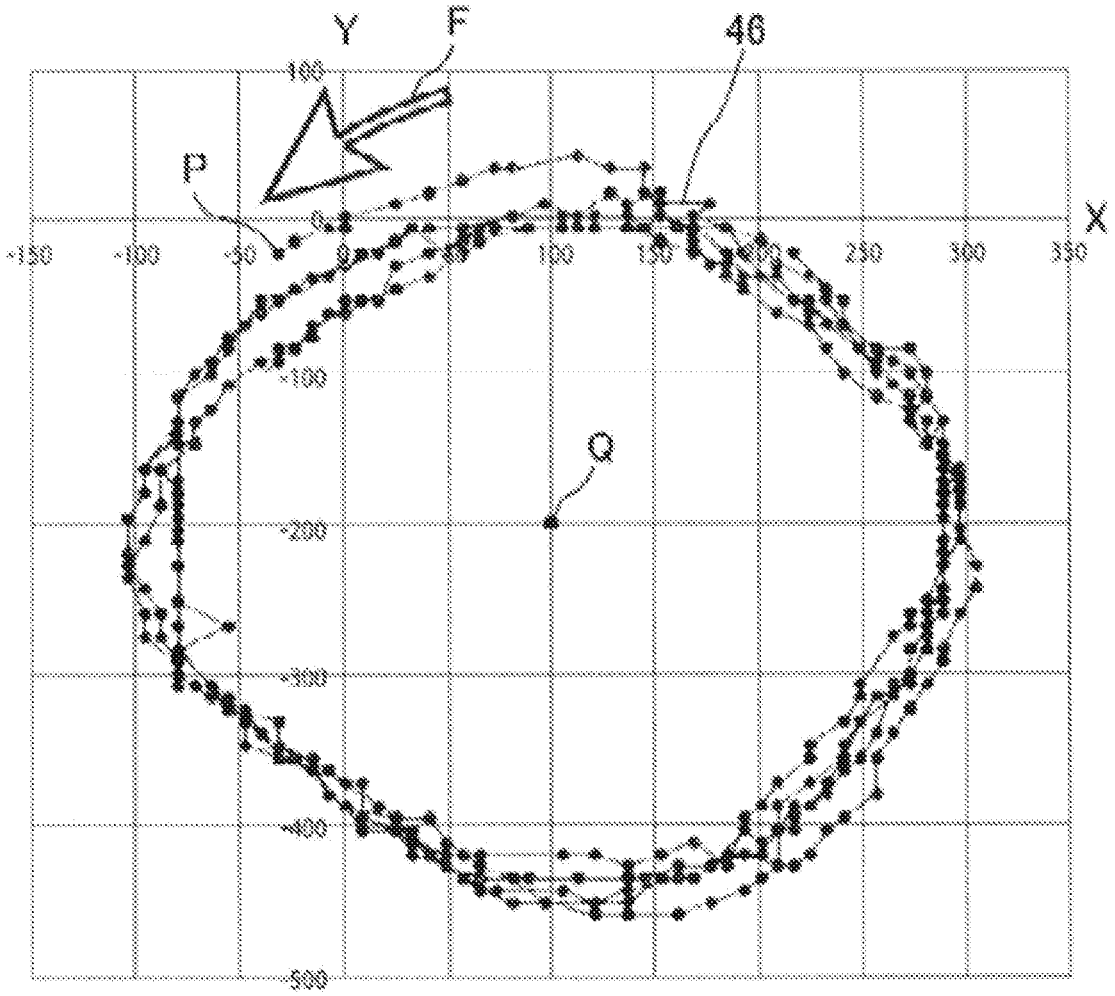
FIG. 12 is a graph showing an example of a track related to the displacement of the rotor shaft detected upon touchdown.

FIG. 12 shows changes of the position signals in an embodiment in which the rotor shaft 21 touches down. In FIG. 12, as with FIG. 10 according to the previous embodiment, the positions where the position signals (Xi, Yi) are acquired are indicated by round dots, and continuous points are sequentially connected by a straight line. The arrow F in FIG. 12 indicates the revolution direction of the rotor shaft 21, and this revolution direction corresponds to the arrow F shown in FIGS. 9A and 9B of the previous embodiment.

The point P shown in the upper left part of FIG. 12 indicates the position of the position signals (Xi, Yi) (end point of the track 46) acquired last, as with FIG. 10 of the previous embodiment. The point Q shown in the center of the diagram indicates the position of the shaft center related to the rotor shaft 21 which is obtained when the magnetic bearings 30, 31 are turned on and thereby the rotor shaft 21 constantly rotates at high speed. Here, as with the previous embodiment, FIG. 12 illustrates the track 46 obtained by the position signals (Xi, Yi) acquired from the radial displacement sensor 30C located at the upper part out of the upper and lower radial displacement sensors 30C.

In this manner, in a case where the rotor shaft 21 touches down, the range of track on the X axis and the Y axis is wider and the shapes of the position signals (Xi, Yi) are relatively larger as compared to the example shown in FIG. 10 in which the rotor shaft 21 does not touch down. However, as with the case in which the rotor shaft 21 does not touch down, the rotation direction thereof can be detected.

What is claimed is:

1. A vacuum pump, comprising:

a rotor shaft;

a motor that rotates the rotor shaft;

a magnetic bearing that magnetically levitates the rotor shaft;

a protective bearing with a predetermined gap between the protective bearing and the rotor shaft;

a displacement sensor that detects a position of the rotor shaft; and control means configured for controlling the motor and the magnetic bearing, wherein the control means:

is configured for obtaining at least a first state in which the rotor shaft rotates at a speed higher than a relatively low speed, and a second state in which the rotor shaft deviates within the gap between the rotor shaft and the protective bearing and rotates at the relatively low speed while revolving;

acquires output information of the displacement sensor;

obtains a rotation direction of the rotor shaft in the second state on the basis of the output information;

determines whether the rotation direction is normal or not; and when the rotation direction is not normal, stops the rotation and increases rotation speed to achieve a normal rotation direction.

2. A control device of a vacuum pump, the control device being connected to a vacuum pump main body, the vacuum pump main body including:

a rotor shaft;

a motor that rotates the rotor shaft;

a magnetic bearing that magnetically levitates the rotor shaft;

a protective bearing with a predetermined gap between the protective bearing and the rotor shaft; and a displacement sensor that detects a position of the rotor shaft, wherein the control device:

is configured for obtaining at least a first state in which the rotor shaft rotates at a speed higher than a relatively low speed, and a second state in which the rotor shaft deviates within the gap between the rotor shaft and the protective bearing and rotates at the relatively low speed while revolving;

acquires output information of the displacement sensor;

obtains a rotation direction of the rotor shaft in the second state on the basis of the output information;

determines whether the rotation direction is normal or not; and when the rotation direction is not normal, stops the rotation and increases rotation speed to achieve a normal rotation direction.

* * * * *